US009291964B2

(12) United States Patent
Fujikura

(10) Patent No.: US 9,291,964 B2
(45) Date of Patent: Mar. 22, 2016

(54) IMAGE FORMATION APPARATUS THAT DETERMINES WHETHER MOTOR DRIVING FORCE IS BEING TRANSMITTED TO FIXING UNIT

(71) Applicant: Oki Data Corporation, Tokyo (JP)

(72) Inventor: Shuichi Fujikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/533,335

(22) Filed: Nov. 5, 2014

(65) Prior Publication Data

US 2015/0125172 A1 May 7, 2015

(30) Foreign Application Priority Data

Nov. 7, 2013 (JP) ..... 2013-231232

(51) Int. Cl.
*G03G 15/20* (2006.01)
*G03G 15/00* (2006.01)

(52) U.S. Cl.
CPC ..... *G03G 15/205* (2013.01); *G03G 15/2032* (2013.01); *G03G 15/2067* (2013.01); *G03G 15/2078* (2013.01); *G03G 15/5004* (2013.01); *G03G 15/5012* (2013.01)

(58) Field of Classification Search
CPC ..... G03G 15/2032; G03G 15/2035; G03G 15/205; G03G 15/2067; G03G 15/2071; G03G 15/2078; G03G 15/5004; G03G 15/5012; G03G 15/50; G03G 15/70; G03G 15/80; G03G 21/1685; G03G 2215/20; G03G 2215/2003
See application file for complete search history.

(56) References Cited

U.S. PATENT DOCUMENTS

2013/0142526 A1* 6/2013 Numazu ..... G03G 21/1685 399/21

FOREIGN PATENT DOCUMENTS

JP 2011-197417 A 10/2011

* cited by examiner

*Primary Examiner* — Joseph S Wong
(74) *Attorney, Agent, or Firm* — Mots Law, PLLC

(57) ABSTRACT

An image formation apparatus includes a fixing unit that heats a medium having a developer image thereon while moving the medium to fix a developer image onto the medium, a motor that provides the fixing unit with a driving force to be used to move the medium, and a controller that determines whether the driving force provided by the motor is being transmitted to the fixing unit.

6 Claims, 7 Drawing Sheets

IMAGE FORMATION APPARATUS THAT DETERMINES WHETHER MOTOR DRIVING FORCE IS BEING TRANSMITTED TO FIXING UNIT

CROSS REFERENCE TO RELATED APPLICATIONS

This application claims priority based on 35 USC 119 from prior Japanese Patent Application No. 2013-231232 filed on Nov. 7, 2013, entitled "IMAGE FORMATION APPARATUS", the entire contents of which are incorporated herein by reference.

BACKGROUND OF THE INVENTION

1. Field of the Invention

The disclosure relates to an image formation apparatus.

2. Description of Related Art

There has been an image formation apparatus that detects replacement of a consumable by detecting a change in the open/close state of an upper cover and carries out a calibration concerning the consumable whose replacement is detected (Patent Literature 1: Japanese Patent Application Publication No. 2011-197417, for example).

SUMMARY OF THE INVENTION

When a fixing unit used in an image formation apparatus is detached and then attached again, a gear to drive the fixing unit is sometimes not joined to a fixing roller of the fixing unit. In this case, the fixing roller cannot rotate, and a medium remains in the fixing unit, causing a printing failure.

Accordingly, an object of an embodiment of the invention is to facilitate determining whether or not the transmission of a driving force from the motor to the fixing unit is active.

An aspect of the invention is an image formation apparatus that includes: a fixing unit that heats a medium having a developer image thereon while moving the medium to fix the developer image onto the medium; a motor that provides the fixing unit with a driving force to be used to move the medium; and a controller that determines whether the driving force provided by the motor is being transmitted to the fixing unit.

According to the above-described aspect, it is possible to facilitate determining whether or not the transmission of a driving force from the motor to the fixing unit is active.

DETAILED DESCRIPTION OF EMBODIMENTS

Figure 1:
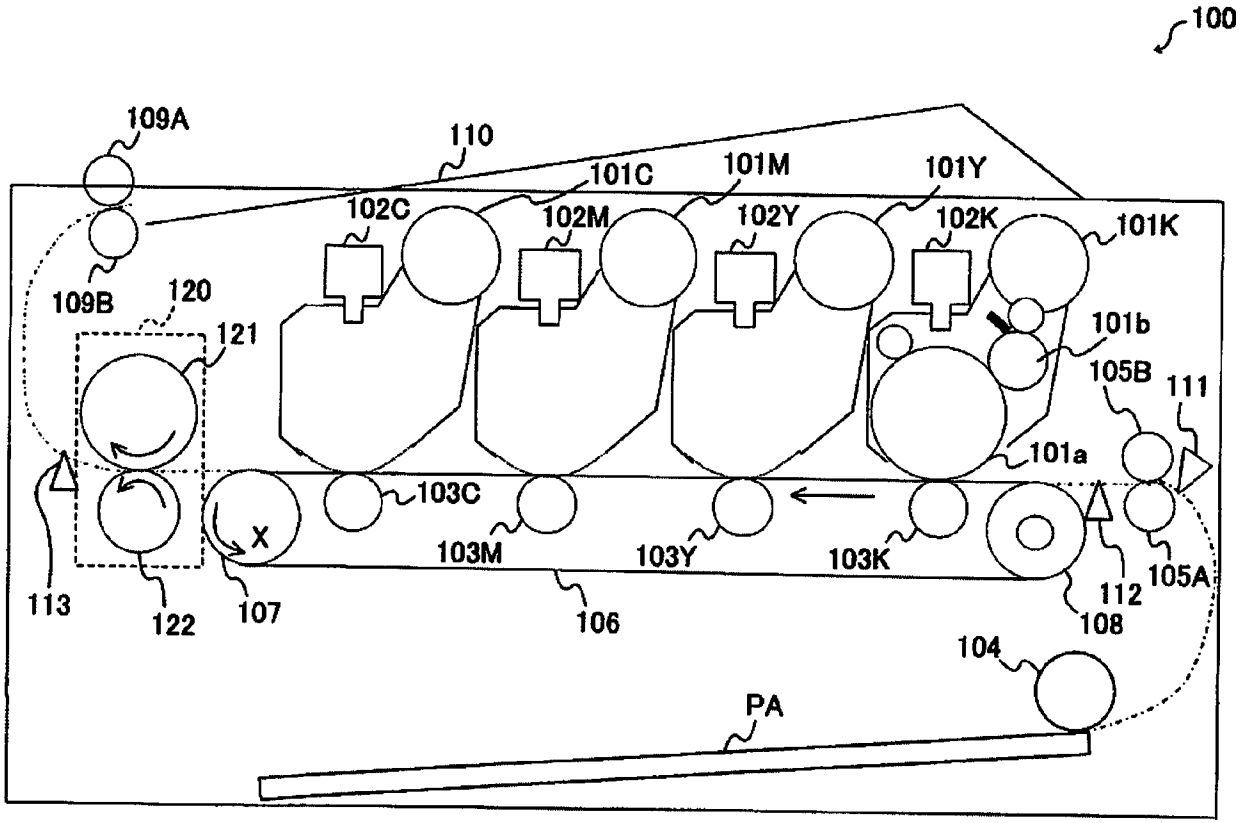
FIG. 1 is a cross-sectional diagram schematically illustrating the configuration of the main portion of a printer as an image formation apparatus according to Embodiment 1.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiment 1

Description of Configuration

FIG. 1 is a cross-sectional view schematically illustrating the configuration of the main part of printer 100 as an image formation apparatus according to Embodiment 1. Printer 100 includes image formation units 101K, 101Y, 101M, and 101C (hereinafter, referred to as image formation units 101 when it is unnecessary for each particular unit to be differentiated), LED heads 102K, 102Y, 102M, and 102C (hereinafter, referred to as LED heads 102 when it is unnecessary for each particular head to be differentiated), transfer rollers 103K, 103Y, 103M, and 103C (hereinafter, referred to as transfer rollers 103 when it is unnecessary for each particular roller to be differentiated), paper feeding roller 104, transport rollers 105A and 105B (hereinafter, referred to as transport rollers 105 when it is unnecessary for each particular roller to be differentiated), transport belt 106, driving roller 107, driven roller 108, delivery rollers 109A and 109B (hereinafter, referred to as delivery rollers 109 when it is unnecessary for each particular roller to be differentiated), stacker 110, IN sensor 111, writing sensor 112, delivery sensor 113, and fixing unit 120.

Image formation unit 101 forms a toner image as a developer image. For example, image formation unit 101 includes a photoreceptor drum 101*a* as an image support body on which an electrostatic latent image and a toner image are formed. LED head 102 is an exposure device configured to form the electrostatic latent image on photoreceptor drum 101*a* by exposing photoreceptor drum 101*a*. Transfer roller 103 is a transfer section configured to transfer the toner image formed by image formation unit 101 onto each medium PA such as paper.

Paper feed roller 104 supplies media PA to transport roller 105 one by one. Transport roller 105 puts each supplied medium PA on transport belt 106. Transport belt 106 is an endless belt and is laid over driving roller 107 and driven roller 108. Driving roller 107 rotates in a direction X as indicated by an arrow in FIG. 1 to move transport belt 106. Driven roller 108 rotates along with the movement of transport belt 106. Delivery roller 109 delivers medium PA with toner fixed thereon by fixing unit 120 to stacker 110.

IN sensor 111 is configured to detect medium PA supplied from paper feeding roller 104. Writing sensor 112 is a sensor configured to detect the leading edge of medium PA for determining the time to start writing. Delivery sensor 113 is configured to detect medium PA discharged from fixing unit 120. Delivery sensor 113 thereby also functions as a sensor to monitor whether medium PA is wound around fixing unit 120.

Fixing unit 120 is configured to fix the toner image on medium PA by heating medium PA while moving medium PA. For example, fixing unit 120 includes fixing roller 121 and fixing back-up roller 122 which heat medium PA while moving medium PA. Fixing roller 121 includes a heat generator such as a halogen lamp inside and is heated to a temperature of about 200° C. to heat medium PA, for example. Fixing back-up roller 122 presses medium PA against fixing roller 121. When fixing roller 121 and fixing back-up roller 122 rotate in predetermined directions as indicated by the arrows in FIG. 1, medium PA moves in the previously determined direction to be discharged from fixing unit 120. Fixing unit 120 has such a structure that a user or a maintenance worker can easily detach fixing unit 120 as a unit of maintenance.

Printer 100 includes motors to rotate rollers, rollers which are provided at intervals not more than the minimum medium distance on the transport path; and clutches used to turn on or off power transmission to the rollers on the transport path, which are not illustrated in FIG. 1.

Figure 2:
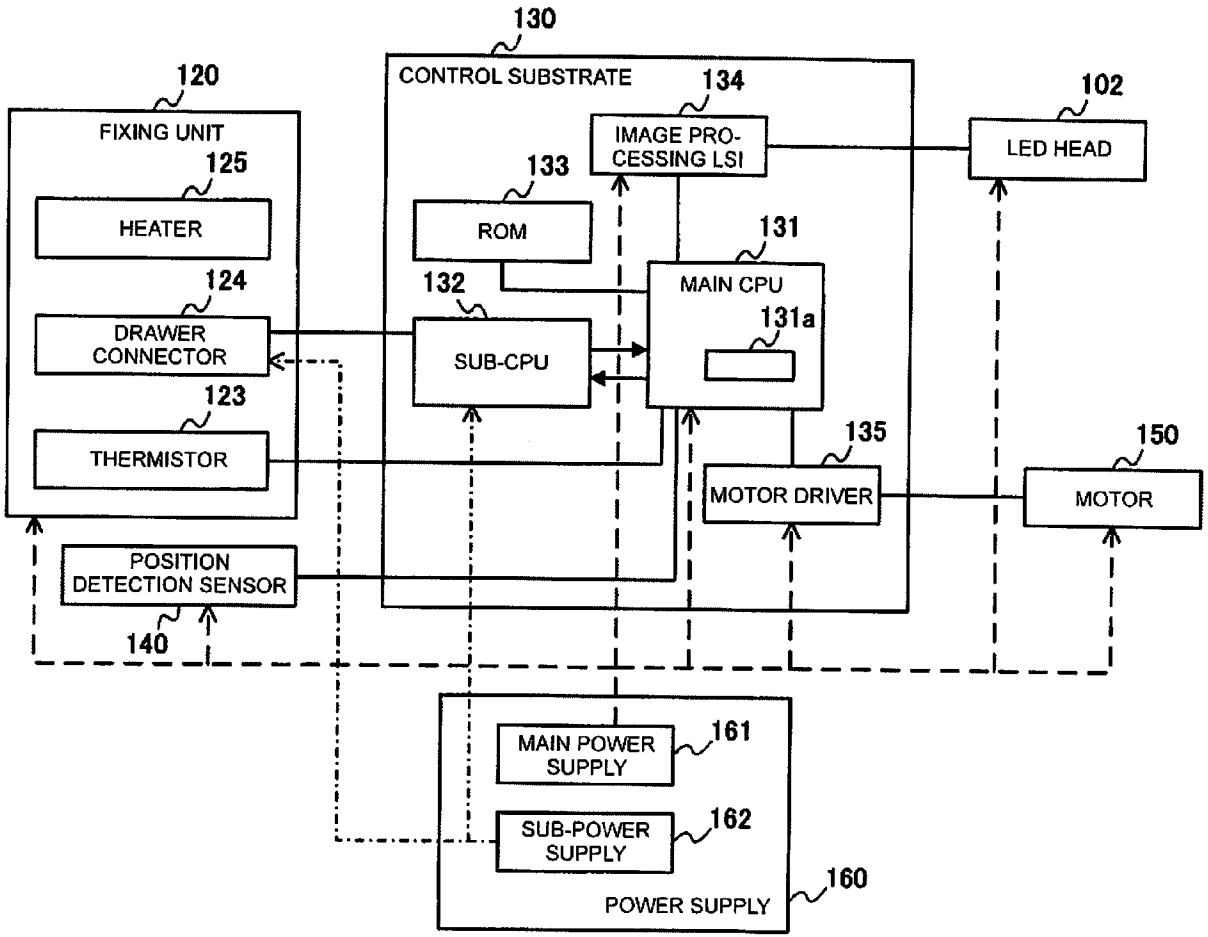
FIG. 2 is a block diagram schematically illustrating the configuration of a control substrate in Embodiment 1.

FIG. 2 is a block diagram schematically illustrating the configuration of control substrate 130 as a controller of printer 100. Control substrate 130 includes: main CPU 131 as a main controller; sub-CPU 132 as a sub-controller; ROM 133 as a storage unit; image processing LSI 134 as an image processing unit controlling LED heads 102; and motor driver 135 as a motor controller to control motor 150. In Embodiment 1, main CPU 131, image processing LSI 134, and motor driver 135 constitute a controller controlling the entire process of printer 100. Motor 150 is configured to provide the driving force used to move medium PA to fixing unit 120.

Main CPU 131 operates according to a program written in ROM 133 and controls the major processing in printer 100. In Embodiment 1, in particular, main CPU 131 determines whether the driving force provided by motor 150 is being transmitted to fixing unit 120. For example, main CPU 131 determines whether fixing unit 120 is attached based on a voltage value detected by thermistor 123 as a fixing unit detector (a fixing unit detection sensor) provided for fixing unit 120. To be specific, when the voltage value detected by thermistor 123 is smaller than a previously determined threshold value, main CPU 131 determines that fixing unit 120 is detached. When fixing unit 120 is attached, main CPU 131 controls motor 150 so that motor 150 provides a driving force to fixing unit 120 for an adjustment operation that adjusts the position of at least one of fixing roller 121 and fixing back-up roller 122. When the adjustment operation is successful, in other words, when it is confirmed that the driving force from motor 150 is being transmitted to fixing roller 121 and fixing back-up roller 122, main CPU 131 performs an initialization (warming up) of fixing unit 120. When the adjustment operation is unsuccessful, main CPU 131 does not perform the initialization of fixing unit 120. Main CPU 131 determines, based on a detection signal from position detection sensor 140, whether the adjustment operation is successful. The adjustment operation is descried later.

Figure 3:
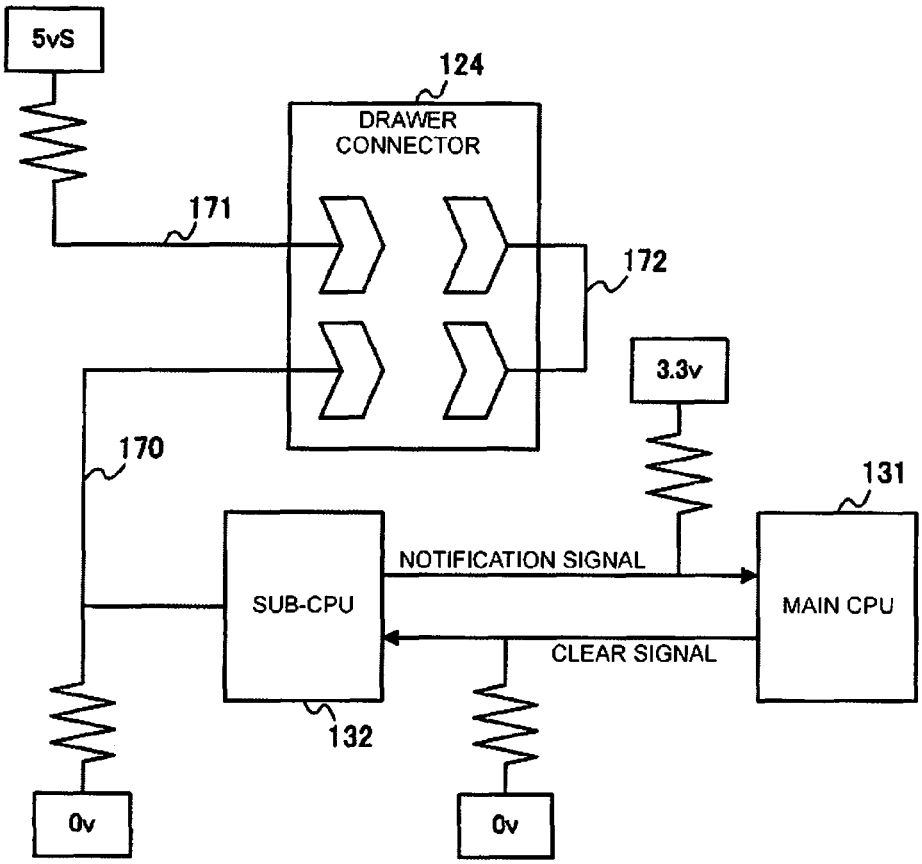
FIG. 3 is a schematic diagram for explaining the relation of connection between a main CPU, a sub-CPU, and a fixing unit in Embodiment 1.

Sub-CPU 132 assists in the processing of main CPU 131. In Embodiment 1, in particular, when main CPU 131 is not supplied with electric power from power supply 160, or when electric power supplied from power supply 160 to main CPU 131 is limited, sub-CPU 132 is supplied with electric power from power supply 160 and detects whether fixing unit 120 is detached. For example, sub-CPU 132 monitors the power switch and a sensor previously determined when power supply 160 of printer 100 is in OFF mode or is in a network stand-by mode (in the sleep mode). In particular, sub-CPU 132 detects whether fixing unit 120 is detached at the OFF or sleep mode of power supply 160. To be specific, as illustrated in FIG. 3, sub-CPU 132 is connected to signal line 170 connected to fixing unit 120 through drawer connector 124. Fixing unit 120 is always subjected to a voltage from power supply 160 through signal line 171. Fixing unit 120 returns the voltage applied through signal line 171 to signal line 170 through signal line 172. When fixing unit 120 is detached, the connection of drawer connector 124 is also disconnected, and sub-CPU 132 is not subjected to a voltage from signal line 170. When not subjected to the voltage from signal line 170, sub-CPU 132 sets to L, a notification signal for main CPU 131 to notify main CPU 131 of the detachment of fixing unit 120. Sub-CPU 132 continues the notification until receiving a clear command from main CPU 131 through a clear signal.

Back to the description of FIG. 2, image processing LSI 134 assists in the image processing of main CPU 131. This is because the image processing cannot be performed at a speed high enough only by main CPU 131. Motor driver 135 controls motor 150 in accordance with an instruction from main CPU 131.

Power supply 160 supplies electric power to each section of printer 100. Power supply 160 includes main power supply 161 and sub-power supply 162, for example. Main power supply 161 supplies power to each section of printer 100 during the normal mode. In the example illustrated in FIG. 2, main power supply 161 supplies electric power to LED head 102, fixing unit 120, main CPU 131, ROM 133, image processing LSI 134, motor driver 135, position detection sensor 140, and motor 150. Sub-power supply 162 is configured to supply electric power to previously determined sections of printer 100 during the sleep and OFF modes. In the example illustrated in FIG. 2, sub-power supply 162 supplies electric power to sub-CPU 132 and drawer connector 124.

The normal mode is a mode in which electric power is supplied to at least heater 125 of fixing unit 120 and motor 150. In Embodiment 1, electric power is also supplied to main CPU 131, which consumes a large amount of power, during the normal mode. The sleep mode is a mode in which electric power is supplied to only the previously determined sections of printer 100 so that the power consumption is less than that of the normal mode. In the sleep mode, electric power is not supplied to at least one of heater 125 and motor 150. In Embodiment 1, in the sleep mode, electric power is not supplied to main CPU 131, heater 125, and motor 150 so that the power consumption is not more than 4 W. Main power supply 161 may be configured to supply electric power to only a predetermined section of main CPU 131 during the sleep mode. The OFF mode is a mode in which power supply 160 is off. In Embodiment 1, electric power is not supplied to main CPU 131, heater 125, and motor 150 so that the power consumption during the OFF mode is not more than 1 W, and only the power switch and minimum required sensors, such as a sensor detecting the user's touch to raise an alarm, are monitored. Herein, the normal mode is included in a first mode in which main CPU 131 is supplied with electric power from main power supply 161. The sleep and OFF modes are included in a second mode in which main CPU 131 is not supplied with electric power from main power supply 161. Main CPU 131 may be supplied with electric power from sub-power supply 162 also in the sleep and OFF modes (the second mode). However, the electric power supplied to main CPU 131 in the sleep and OFF modes is limited to less than that in the normal mode (the first mode). In power supply 160, main power supply 161 and sub-power supply 162 are switched under the control of main CPU 131 and sub-CPU 132. This can change the power supply mode described above.

Main CPU 131 controls a belt, a motor to transport print media, and a motor or a clutch driver to drive a clutch as a driving system (not illustrated in FIG. 2).

Figure 4:
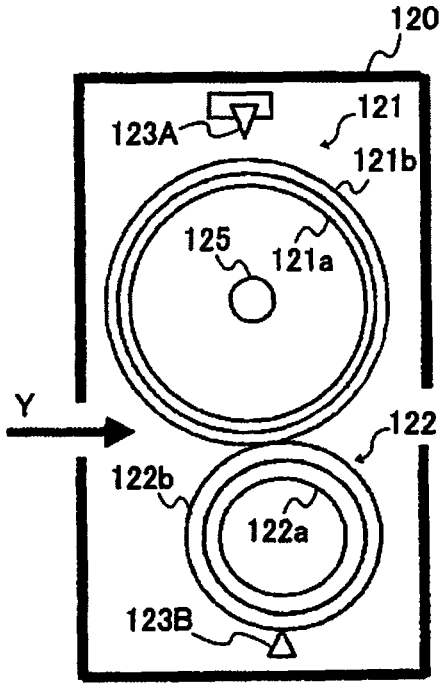
FIG. 4 is a cross-sectional diagram schematically illustrating the configuration of the fixing unit in Embodiment 1.

FIG. 4 is a cross-sectional diagram schematically illustrating the configuration of fixing unit 120 in Embodiment 1. Arrow Y in FIG. 4 indicates the direction that media PA are transported. Fixing unit 120 includes fixing roller 121, fixing back-up roller 122, upper thermistor 123A, lower thermistor 123B, and heater 125.

Heater 125 is a halogen heater which receives electric power from power supply 160 to heat fixing roller 121 under the control of main CPU 131. Fixing roller 121 receives and accumulates the heat from heater 125 and adds heat to the toner transferred to medium PA. Upper thermistor 123A detects the temperature of fixing roller 121. Lower thermistor 123B detects the temperature of fixing back-up roller 122. Upper and lower thermistors 123A and 123B constitute the thermistor 123 illustrated in FIG. 2.

Fixing roller 121 and fixing back-up roller 122 include aluminum or iron tubes 121*a* and 121*a* inside, respectively. The outer portions thereof are composed of rubber members 121*a* and 122*b* as elastic members to increase the adhesion to the media, respectively. Fixing unit 120 is provided with a spring which energizes at least one of fixing roller 121 and fixing back-up roller 122 so as to compress rubber members 121*b* and 122*b*.

When a medium constructed of layers of paper like an envelope is transported to fixing unit 120 configured as described above, wrinkles occur because fixing roller 121 and fixing back-up roller 122 rotate at different speeds and the like. In order to prevent the occurrence of wrinkles during printing on a thick medium such as an envelope, printer 100 includes an adjustment mechanism (an adjustment unit) configured to reduce the pressing force of fixing roller 121 against fixing back-up roller 122.

Figure 5:
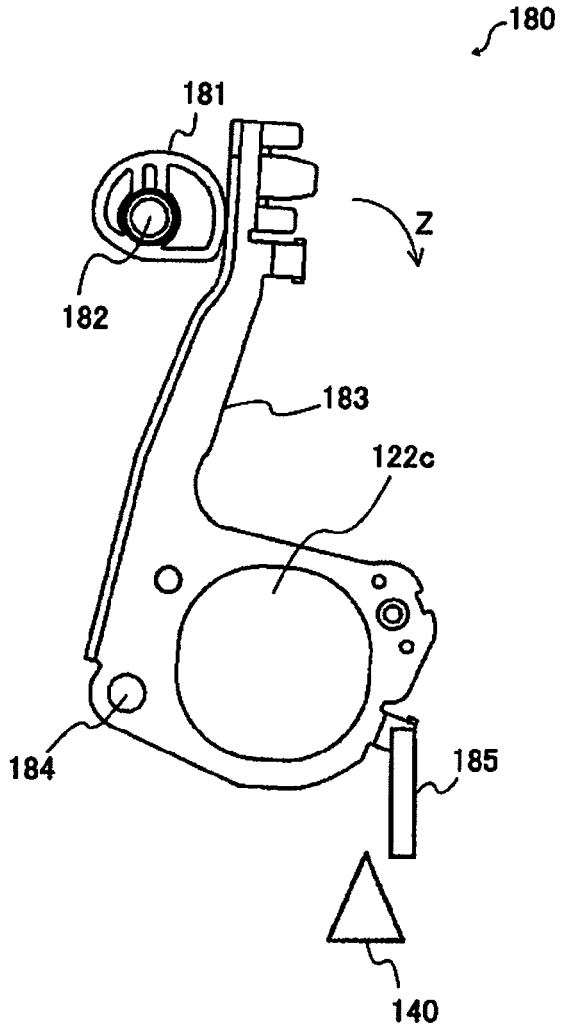
FIG. 5 is a schematic diagram illustrating an example of an adjustment mechanism in Embodiment 1.

FIG. 5 is a schematic diagram illustrating an example of the adjustment mechanism in Embodiment 1. Adjustment mechanism 180 includes cam 181, first axle 182, arm 183, second axle 184, and lever 185. Cam 181 rotates about first axle 182. Arm 183 rotates about second axle 184. An end of arm 183 is in contact with cam 181. Cam 181 varies in thickness between the outer surface and first axle 182. Accordingly, when cam 181 rotates, the contact point with arm 183 shifts from the thin portion of cam 181 to the thick portion, and arm 183 thereby rotates about second axle 184 in the direction of arrow Z in FIG. 5.

The other end of arm 183 is attached to axle 122*c* of fixing back-up roller 122. Accordingly, fixing back-up roller 122 is moved in the direction of arrow Z when arm 183 rotates in the direction of arrow Z. Adjustment mechanism 180 thus configured is attached to each end of fixing back-up roller 122. When fixing back-up roller 122 is moved in the direction of arrow Z, fixing roller 121 moves away from fixing back-up roller 122, thus reducing the pressing force of fixing roller 121 against fixing back-up roller 122.

Lever 185 is attached to arm 183, and position detection sensor 140 detects a change in the position of lever 185. Position detection sensor 140 is an optical sensor including a light emitting unit and a light receiving unit, which are not shown, for example. When arm 183 is moved in direction Z, that is, when fixing back-up roller 122 is moved to the position previously determined, for example, the light from the light emitting unit is blocked by lever 185. Position detection sensor 140 thereby detects that fixing back-up roller 122 is moved to the position previously determined, that is, detects that adjustment mechanism 180 operates normally.

Cam 181 is rotated through a transmission mechanism including at least one gear by driving force from motor 150 as the driving source which rotates fixing roller 121 and fixing back-up roller 122.

Figure 6:
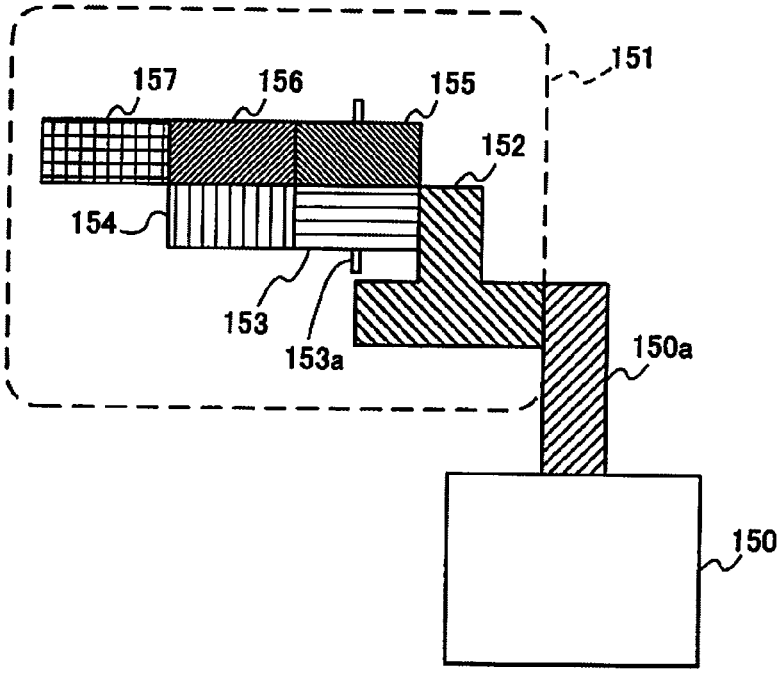
FIG. 6 is a schematic diagram for explaining a transmission mechanism in Embodiment 1.

FIG. 6 is a schematic view for explaining a transmission mechanism for transmitting a driving force from motor 150 to cam 181, fixing roller 121, and fixing back-up roller 122. Transmission mechanism 151 includes first gear 152, second gear 153, fixing roller gear 154, one-way gear 155, third gear 156, and cam gear 157.

Motor gear 150*a* rotated by motor 150 is engaged with first gear 152. First gear 152 is engaged with second gear 153, and second gear 153 is engaged with fixing roller gear 154 connected to fixing roller 121. When motor gear 150*a* is rotated by motor 150, a driving force is transmitted through first and second gears 152 and 153 to fixing roller gear 154 rotating fixing roller 121.

Rotary shaft 153*a*, rotated together with second gear 153, is provided with a one-way gear 155. One-way gear 155 includes a clutch inside. One-way gear 155 is configured not to rotate when rotary shaft 153*a* rotates in a normal direction, or in other words, when fixing roller 121 rotates in such a direction that media PA is delivered, but to rotate only when rotary shaft 153*a* rotates in the reverse direction. One-way gear 155 is engaged with third gear 156, and third gear 156 is engaged with cam gear 157 connected to first shaft 182 to rotate cam 181. Accordingly, when motor gear 150*a* is rotated in the reverse direction by motor 150, cam 180 is rotated by one-way gear 155, third gear 156, and cam gear 157, and arm 183 is moved in the direction Z. Fixing back-up roller 122 is moved to the position previously determined, thus reducing the pressing force of fixing roller 121 against fixing back-up roller 122. When adjustment mechanism 180 operates normally, the driving force from motor 150 is transmitted to transmission mechanism 151 described above, or in other words, the driving force from motor 150 is transmitted to fixing roller 121 and fixing back-up roller 122. Generally, gears cannot be rotated in the reverse direction if they are not engaged securely. Therefore, it can be confirmed that the gears are securely engaged with each other by operating motor 150 in the reverse direction to confirm that the driving force from motor 150 is being transmitted to transmission mechanism 151.

In Embodiment 1, all or a part of transmission mechanism 151 is provided for fixing unit 120. When fixing unit 120 is detached, all or a part of transmission mechanism 151 is detached together with fixing unit 120. Herein, a part of transmission mechanism 151 includes second gear 153, fixing roller gear 154, one-way gear 155, third gear 156, and cam gear 157, for example.

(Explanation of Operation)

Hereinafter, a description is given of the operation of printer 100 in Embodiment 1. Printer 100 is connected to a host by a wired or wireless communication link (not illustrated). Print data is transferred from the host to printer 100. Upon receiving an instruction to print, main CPU 131 rotates paper feeding roller 104 to feed one medium PA to transport roller 105.

Image formation unit 101 starts the rotation of the rollers substantially at the same time as the start of the paper feed. Along with the start of the rotation, driving roller 107 rotates, and transport belt 106 also starts moving at a constant speed. Each medium PA skews when separated by paper feeding roller 104. Medium PA hits transport roller 105 which is not rotating so that the skew thereof is removed.

When medium PA hits transport roller 105, transport roller 105 is connected to power by the clutch so to rotate. Medium PA is further transported and turns ON write sensor 112. Within a certain period of time after write sensor 112 is turned ON, LED head 102K starts an exposure to form an electrostatic latent image on photoreceptor drum 101*a*. Development roller 101*b* supplies toner to the formed electrostatic latent image to form a toner image on photoreceptor drum 101*a*. The toner image is transferred to medium PA by applying a voltage of about +3000 V to transfer roller 103K. In a similar manner, an exposure and transfer are sequentially performed for images of the other colors. When the transfer to medium PA is finished, medium PA is heated and pressurized between fixing roller 121 heated to about 200° C. and fixing back-up roller 122, so that the toner image is fixed on medium PA. After the fixing, medium PA turns ON delivery sensor 113 and then is delivered to stacker 110 by delivery roller 109.

In some cases, the driving force from motor 150 is not transmitted to fixing roller 121 and fixing back-up roller 122 because of a disconnection of the gears that drive fixing roller 121 and fixing back-up roller 122 or the like. In such a case, medium PA enters fixing unit 120, in which the surface temperature of fixing roller 121 is maintained at 200° C., and the temperature control is carried out with medium PA staying in fixing unit 120. Normally, medium PA is heated while moving, and the surface of medium PA is heated to about 100° C. However, medium PA is heated to about 200° C. when medium PA stays in fixing unit 120. When medium PA is paper, medium PA turns yellow. When medium PA is made of a low heat resistant film, medium PA melts and sticks to fixing roller 121 and fixing back-up roller 122. The film sticking to fixing roller 121 and fixing back-up roller 122 prevents thermistor 123 from detecting the correct temperature, thus causing a printing failure.

In Embodiment 1, when fixing unit 120 is detached, it is confirmed by using adjustment mechanism 180 described above by determining whether the driving force from motor 150 is being transmitted to fixing roller 121 and fixing back-up roller 122. Specifically, main CPU 131 activates adjustment mechanism 180. When position detection sensor 140 detects a movement of fixing back-up roller 122, main CPU 131 determines that fixing unit 120 is normally attached and goes to the normal printing operation. On the other hand, when position detection sensor 140 cannot detect movement of fixing back-up roller 122, main CPU 131 notifies the user of an error and does not go to the printing operation. In Embodiment 1, the adjustment operation is carried out by main CPU 131 that operates motor 150 in the reverse direction.

Detachment of fixing unit 120 is monitored by main CPU 131 and sub-CPU 132. Sub-CPU 132 is supplied with electric power even when power supply 160 is in the OFF mode and sleep mode and therefore monitors for detachment of fixing unit 120 in the OFF mode and sleep mode.

Figure 7:
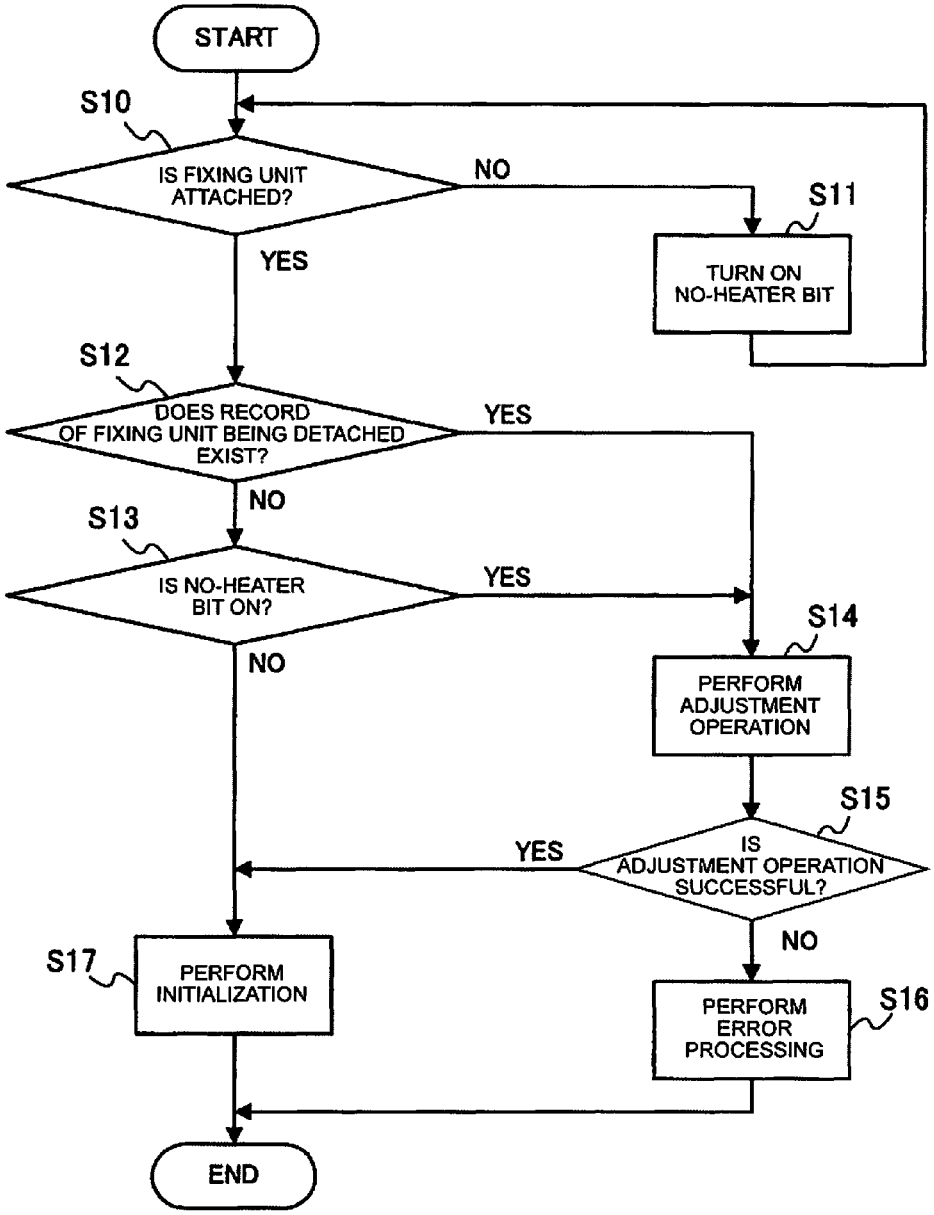
FIG. 7 is a flowchart illustrating a process to monitor the fixing unit in Embodiment 1.

FIG. 7 is a flowchart illustrating a process of monitoring fixing unit 120 in Embodiment 1. The flowchart illustrated in FIG. 7 is started when power supply 160 is turned on (returns to the normal mode from the OFF mode), when power supply 160 returns from the sleep mode to the normal mode, or when the cover of printer 100 is closed. In these cases, registers (not illustrated) are set to initial values, and a judgment routine for fixing unit 120 is started.

Main CPU 131 determines whether fixing unit 120 is attached to printer 100 (S10). Main CPU 131 performs the determination by using a voltage detected by thermistor 123, for example. When fixing unit 120 is not attached to printer 100 (No in S10), the process goes to step S11. When fixing unit 120 is attached to printer 100 (Yes in S10), the process goes to step S12.

In step S11, main CPU 131 turns on a no-heater bit which is reserved in memory 131*a* as a work memory. In this process, main CPU 131 notifies the user by displaying an error screen on a display section (not illustrated) or by another means and then returns the process to step S10. The no-heater bit indicates information on whether fixing unit 120 is detached from printer 100 when power supply 160 of printer 100 is in the normal mode.

In step S12, main CPU 131 determines whether there is a record of fixing unit 120 being detached. Main CPU 131 determines that the record of fixing unit 120 being detached exists when the notification signal from sub-CPU is L and determines that the record of fixing unit 120 being detached does not exist when the notification signal from sub-CPU 132 is H. Herein, the existence of the record of fixing unit 120 being detached represents that fixing unit 120 is detached from printer 100 at least when power supply 160 of printer 100 is in the OFF mode or sleep mode. When the record of fixing unit 120 being detached does not exist (No in S12), the process goes to step S13. When the record of fixing unit 120 being detached exists (Yes in S12), the process goes to step S14.

In step S13, main CPU 131 confirms whether the no-heater bit in memory 131*a* is on. When the no-heater bit is on (Yes in S13), the process goes to step S14. When the no-heater bit is off (No in S13), the process goes to step S17.

In step S14, main CPU 131 operates motor 150 in the reverse direction for an adjustment operation by adjustment mechanism 180. Main CPU 131 then determines whether the adjustment operation is successful (S15). For example, main CPU 131 determines that the adjustment operation is successful when receiving the detection signal from position detection sensor 140 within a predetermined period of time after the adjustment operation is started. Main CPU 131 determines that the adjustment operation is unsuccessful when not receiving the detection signal from position detection sensor 140 within the predetermined period of time after the adjustment operation is started. When the adjustment operation is unsuccessful (No in S15), the process goes to step S16. When the adjustment operation is successful (Yes in S15), the process goes to step S17.

In step S16, main CPU 131 performs error processing. The error processing includes notifying the user by displaying an error screen in a display section (not illustrated), stopping motors in operation, and the like, for example.

In step 17, main CPU 131 starts an initialization (warming up) of printer 100, especially, fixing unit 120. The initialization includes an energization of heater 125. Moreover, main CPU 131 sends the clear signal to sub-CPU 132 and turns off the no-heater bit in memory 131*a*.

As described above, according to Embodiment 1, when fixing unit 120 is detached and then attached, it is confirmed whether the driving force from motor 150 is being transmitted to fixing unit 120 before starting the warming up of fixing unit 120. Accordingly, the operations of fixing roller 121 and fixing back-up roller 122 of fixing unit 120 can be checked before an energization of heater 125 of fixing unit 120, thus ensuring safety. In Embodiment 1, the operation check of fixing unit 120 is not performed when fixing unit 120 has not been detached. In this case, it is possible to shorten the warm-up time of fixing unit 120 and to restart the printing within a shorter time period.

As described above, Embodiment 1 is described by using printer 100 as the image formation apparatus as an example. In addition to printer 100, the invention is applicable to image formation apparatuses such as electrophotographic copiers, facsimiles, and multi function peripherals (MFPs) including the functions of printers, copiers, and facsimiles.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising:

a fixing unit configured to heat a medium while moving the medium to fix a developer image on the medium;

a motor configured to provide the fixing unit with a driving force to be used to move the medium;

a controller configured to determine whether the driving force provided by the motor is being transmitted to the fixing unit;

a power supply configured to switch between a first mode in which electric power is supplied to the controller and a second mode in which no electric power or less electric power than that of the first mode is supplied to the controller; and a sub-controller configured to be supplied with electric power from the power supply during the second mode and detect whether the fixing unit is detached, wherein if the sub-controller detects a detachment of the fixing unit during the second mode, the controller determines whether the driving force provided by the motor is being transmitted to the fixing unit after the power supply is switched from the second mode to the first mode.

2. The image formation apparatus according to claim 1, wherein the controller is configured to determine whether the driving force provided by the motor is being transmitted to the fixing unit when the fixing unit is attached.

3. The image formation apparatus according to claim 1, wherein the controller is configured to determine whether the driving force provided by the motor is being transmitted to the fixing unit before performing a warming-up of the fixing unit and, when the driving force provided by the motor is not being transmitted to the fixing unit, the controller does not perform the warming-up of the fixing unit.

4. The image formation apparatus according to claim 1, wherein the fixing unit includes:

a fixing roller and a fixing back-up roller which are configured to receive the driving force from the motor to rotate in predetermined directions, and to heat the medium while moving the medium: and an adjustment mechanism configured to adjust a position of at least one of the fixing roller and fixing back-up roller when the fixing roller and the fixing back-up roller are rotated in directions reverse to the predetermined directions by using the driving force provided by the motor, and the controller is configured to control the motor so that the fixing roller and the fixing back-up roller rotate in the reverse directions and to determine whether the driving force provided by the motor is being transmitted to the fixing unit based on whether the adjustment by the adjustment mechanism is successful.

5. The image formation apparatus according to claim 4, wherein the adjustment mechanism is configured to move the fixing back-up roller to a previously determined position when the fixing roller and fixing back-up roller are rotated in the reverse directions.

6. The image formation apparatus according to claim 5, further comprising:

a position detection sensor configured to detect whether the fixing back-up roller is moved to the previously determined position, wherein the controller determines based on a detection signal from the position detection sensor whether the driving force provided by the motor is being transmitted to the fixing unit.

* * * * *